US007914182B2

(12) United States Patent
Mrakovich et al.

(10) Patent No.: US 7,914,182 B2
(45) Date of Patent: Mar. 29, 2011

(54) DECORATIVE LIGHT FIXTURE INCLUDING COOLING SYSTEM

(75) Inventors: Matthew S. Mrakovich, Streetsboro, OH (US); Mark J. Mayer, Sagamore Hills, OH (US); Thomas E. Zink, North Royalton, OH (US); Timothy Mazies, Palos Park, IL (US); James T. Petroski, Parma, OH (US)

(73) Assignee: GE Lighting Soutions, LLC, Cleveland, OH (US)

( * ) Notice: Subject to any disclaimer, the term of this patent is extended or adjusted under 35 U.S.C. 154(b) by 245 days.

(21) Appl. No.: 12/242,100

(22) Filed: Sep. 30, 2008

(65) Prior Publication Data

US 2010/0079998 A1 Apr. 1, 2010

(51) Int. Cl.
*F21V 29/00* (2006.01)

(52) U.S. Cl. ..... 362/373; 362/431; 362/365

(58) Field of Classification Search ..... 362/294, 362/373, 218, 547, 431
See application file for complete search history.

(56) References Cited

U.S. PATENT DOCUMENTS

| | | | | |
|---|---|---|---|---|
| 7,144,135 | B2 * | 12/2006 | Martin et al. | 362/294 |
| 7,686,469 | B2 * | 3/2010 | Ruud et al. | 362/101 |
| 2002/0144809 | A1 | 10/2002 | Siu | |
| 2005/0146874 | A1 | 7/2005 | Cech et al. | |
| 2007/0195527 | A1 | 8/2007 | Russell | |
| 2008/0025028 | A1 | 1/2008 | Gloisten et al. | |
| 2008/0049399 | A1 | 2/2008 | Lu et al. | |
| 2008/0080196 | A1 | 4/2008 | Ruud et al. | |
| 2008/0112168 | A1 * | 5/2008 | Pickard et al. | 362/247 |

FOREIGN PATENT DOCUMENTS

| | | |
|---|---|---|
| WO | WO 2004/088761 | 10/2004 |
| WO | WO 2008/061082 | 5/2008 |

OTHER PUBLICATIONS

European Patent Office Search Report for EP 09171786.8.

* cited by examiner

*Primary Examiner* — Ali Alavi
(74) *Attorney, Agent, or Firm* — Fay Sharpe LLP

(57) ABSTRACT

A decorative light fixture includes a light engine and a shroud. The light engine includes a heat sink and a light source in thermal communication with the heat sink. The shroud covers the light engine to define an air path between an air inlet and an exhaust. The air inlet is disposed vertically below the exhaust. The air path is shaped to direct air over the heat sink and to exit the shroud above the light engine.

20 Claims, 6 Drawing Sheets

DECORATIVE LIGHT FIXTURE INCLUDING COOLING SYSTEM

BACKGROUND

Decorative light fixtures typically include an attractive housing with a light source that is typically a metal halide lamp or a halogen lamp or an incandescent lamp. These light fixtures work well, but can be improved by using a more efficient and longer lasting light source.

Light emitting diodes (LEDs) can provide a bright, longer lasting light engine as compared to a metal halide lamp or a halogen lamp. LEDs, however, generate a great amount of heat that needs to be dissipated to provide a bright, long lasting light engine. Dissipating this heat can be difficult where it is desirable to use an attractive housing that is similar in configuration to the known decorative housings used with metal halide or halogen lamps.

A known decorative light fixture that employs an LED light engine in a conventional attractive housing, i.e., one that would typically include a metal halide or halogen lamp, conducts heat generated by the LEDs either into a pole upon which the light fixture is mounted or maintains the heat within a glass enclosure that forms a part of the housing. Either situation limits the amount of power that can be delivered to the LEDs. This is due to the pole typically not being a very good heat conductor or that the heat maintained within the glass enclosure results in heat still being maintained in a volume that is adjacent the LEDs. Furthermore, where the heat is dissipated into the pole upon which the light fixture is mounted, the pole can get hot. Also, for light fixtures where no pole is provided, e.g. a pendent light fixture, there is no pole which can act as a heat sink.

Another drawback with known attractive light fixtures that employ an LED light engine is that the LEDs are point light sources, which are visible when viewing the light fixture from horizontal. When these point light sources are visible, this can result in an unattractive look for the light fixture.

SUMMARY

A decorative light fixture that overcomes the aforementioned shortcomings includes a light engine and a shroud. The light engine includes a heat sink and a light source in thermal communication with the heat sink. The shroud covers the light engine to define an air path between an air inlet and an exhaust. The air inlet is disposed vertically below the exhaust. The air path is shaped to direct air over the heat sink and to exit the shroud above the light engine.

The air inlet and the exhaust can each be in communication with ambient. The area of the air inlet can be at least about 20% larger than the area of the exhaust. The area of the exhaust can be less than about 30% larger than the area of the air inlet. The shroud can define a central axis and a cross sectional area normal to the central axis of a volume surrounded by the shroud adjacent the air inlet can be greater than the cross-sectional area normal to the central axis of the volume adjacent the outlet.

The heat sink can include a base and fins. The fins can extend upwardly from the base and radiate from the central axis. The heat sink can further include a central pillar coaxial with the central axis that extends upwardly from and normal to the base. Some fins can have internal edges that are contiguous with the pillar and some fins can have internal edges that are spaced from the pillar. The heat sink can also include fins where the cross-sectional area normal to the central axis of an envelope, which is the area surrounded by the shroud less the area occupied by the fins, is at least about 90% and less than about 150% of the area of the air inlet.

The shroud can taper inwardly toward a vertical axis. The shroud can also define a vertical axis and the heat sink can include fins that radiate from the vertical axis. The fins can include a contoured distal edge and an inner surface of the shroud can be contoured to generally follow at least one distal edge of the fins.

The fixture can further include a lower housing connected to the shroud. The lower housing can include openings shaped to receive associated glass panels. The openings can be in communication with the air inlet such that air from ambient entering the air inlet passes through the openings. The light fixture can further include translucent panels received in these openings. A lower most edge of the light engine can be disposed vertically above at least one of a lower most edge of the shroud or an uppermost edge of the openings in the lower housing.

The fixture can also include a lower housing connected to the shroud where the light source is a plurality of LEDs. The LEDs can be hidden by the shroud or the lower housing when viewed from horizontal at an elevation equal to an elevation of the LEDs. The fixture can also include a translucent cover connected to the heat sink to define a sealed cavity. The light source can be disposed in the sealed cavity. Portions of a peripheral edge of the heat sink can also be spaced from an internal surface of the shroud.

DETAILED DESCRIPTION

Figure 1:
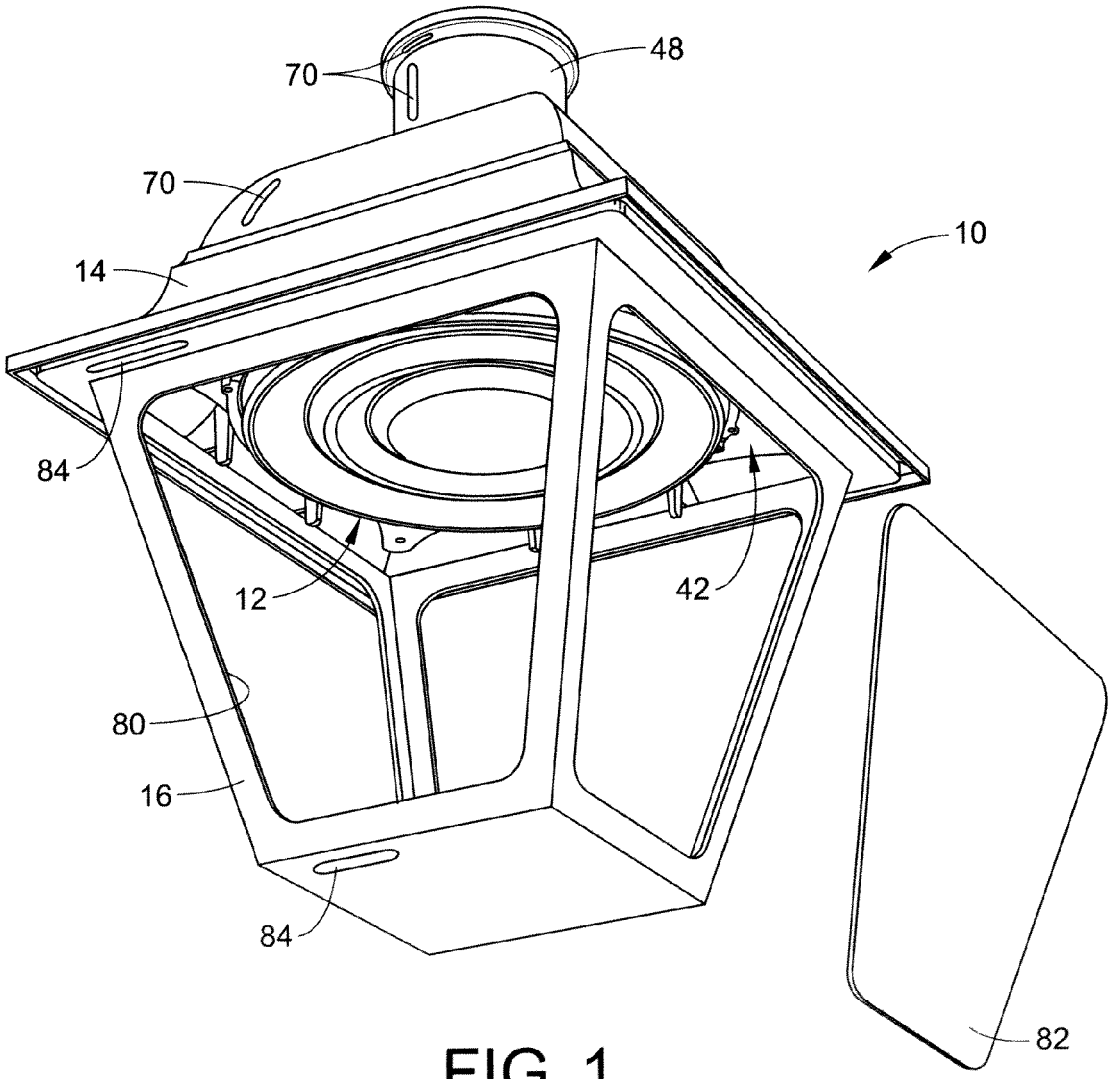
FIG. 1 is a perspective view of a decorative light fixture.

With reference to FIG. 1, a decorative light fixture 10 includes a light engine 12 disposed within a housing where the housing includes a shroud 14 and a lower housing 16 connected to the shroud. The decorative light fixture 10 can mount to a post where the light fixture illuminates a pathway, a street or another area. In this instance, the light fixture can have a similar look to decorative light fixtures that typically include a 75 watt metal-halide lamp. The light fixture can also be useful as a pendant light, where no pole is provided but instead the light fixture hangs from a bracket or other support.

Figure 2:
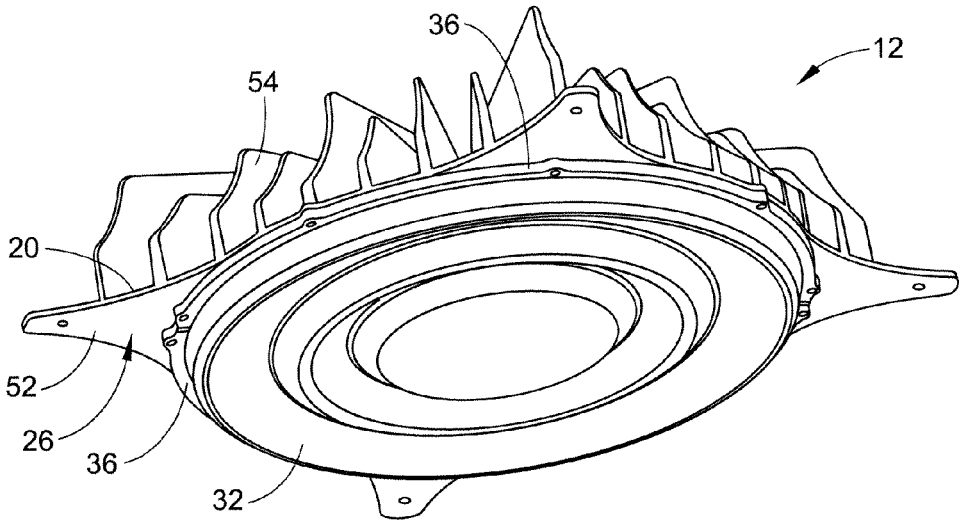
FIG. 2 is a perspective view of a light engine for the decorative light fixture of FIG. 1.
Figure 3:
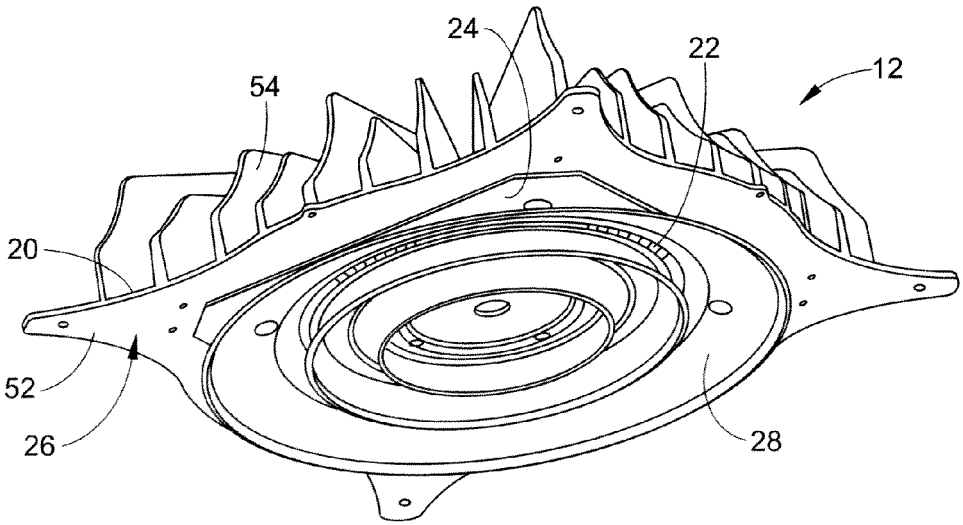
FIG. 3 is a perspective view of the light engine shown in FIG. 2 with a translucent cover and retaining members for the translucent cover removed.

With reference to FIGS. 2 and 3, the light engine 12 includes a heat sink 20 and a light source in thermal communication with the heat sink. In the depicted embodiment, the light source is a plurality of LEDs 22 mounted on a printed circuit board ("PCB") 24 attached to a lower surface 26 of the heat sink 20. The light engine 12 also includes reflectors 28 that redirect light emanating from the LEDs 22. The reflectors 28 could be replaced by refractive optics to redirect light where it is desired. A translucent cover 32 attaches to the lower surface 26 of the heat sink 20 and defines a sealed cavity 34 (FIG. 4) in which the electrical components of the LED light engine are housed. With reference back to FIG. 2, brackets 36 are used to attach the translucent cover 32 to the lower surface 26 of the heat sink 20. The light engine 12 is more particularly described in International Application No. PCT/US2008/70184, which is incorporated by reference in its entirety.

LED light engines can require aggressive cooling to provide a bright long lasting light source. Where a decorative lighting fixture is desired, it can be difficult to allow for adequate air flow and adequate surface area of the heat sink to cool the LED light engine. By shaping an internal surface 38 of the shroud 14 to direct cool air over the heat sink 20, natural convection can be used to cool the LED light engine 14 without the need for a fan or heat pipe. Additionally, the heat does not need to be conducted into a pole upon which the light fixture can be mounted. This allows the light fixture to be used as a pendant light since no pole is required for a heat sink.

Figure 4:
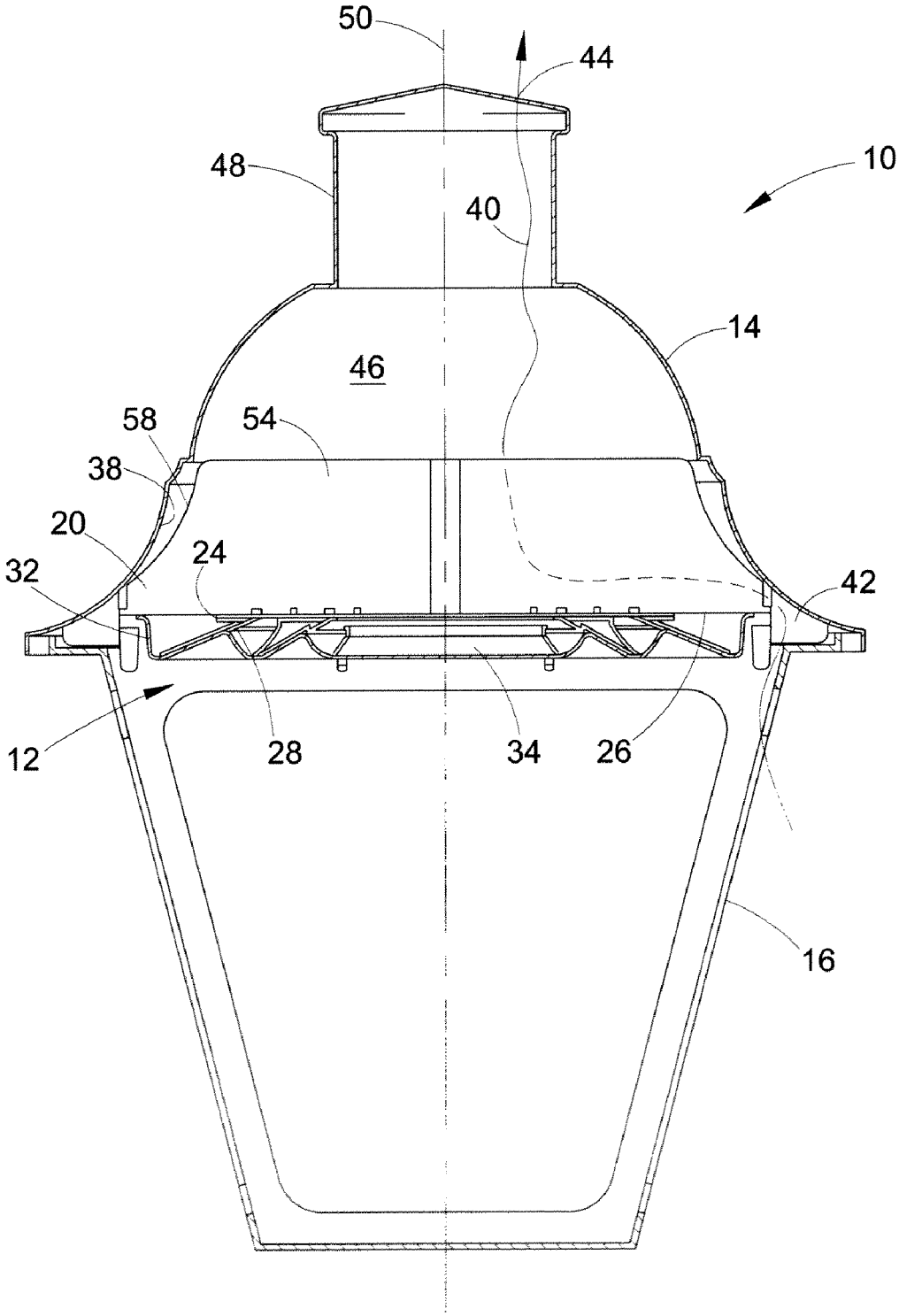
FIG. 4 is a side cross-sectional view taken along line 4-4 in FIG. 7 (the translucent cover shown in FIG. 4 is the same as FIG. 2 as opposed to FIG. 7).

With reference to FIG. 4, the decorative shroud 14 covers the light engine 12 to define an air path, designated by arrow 40, between an air inlet 42 and an exhaust 44. The air inlet 42 is disposed vertically below the exhaust 44. Air moves between the air inlet and the exhaust via natural convection—fans to move the air and additional heat removal components, e.g. heat pipes, can be unnecessary. The air path is shaped to direct air over the heat sink 20 so that the air exits the shroud 14 above the light engine 12. Both the air inlet 42 and the exhaust 44 are in communication with ambient. The shroud also defines an internal volume 46 covering the heat sink 20.

The shroud 14 defines a vertical axis 50, which is also a central axis of the light fixture 10. In the illustrated embodiment, the shroud 14 tapers inwardly toward the vertical axis from a lower edge towards an upper end of the shroud. More particular to the embodiment that is illustrated, the shroud 14 tapers toward a cylindrical section 48 that is at the top of the shroud and concentric with the vertical central axis 50. The cross-sectional area of the internal volume 46 taken normal to the central axis 50 adjacent the inlet 42 (see FIG. 5) and not occupied by the heat sink 20 is greater than the cross-sectional area of the internal volume taken normal to the central axis adjacent the outlet. Also, cross sectional areas taken above the heat sink 20 can be less than the area of the inlet 44. This facilitates the shroud acting as a chimney to efficiently remove heat that is generated by the LEDs 22 (FIG. 3) from the light fixture.

Figure 6:
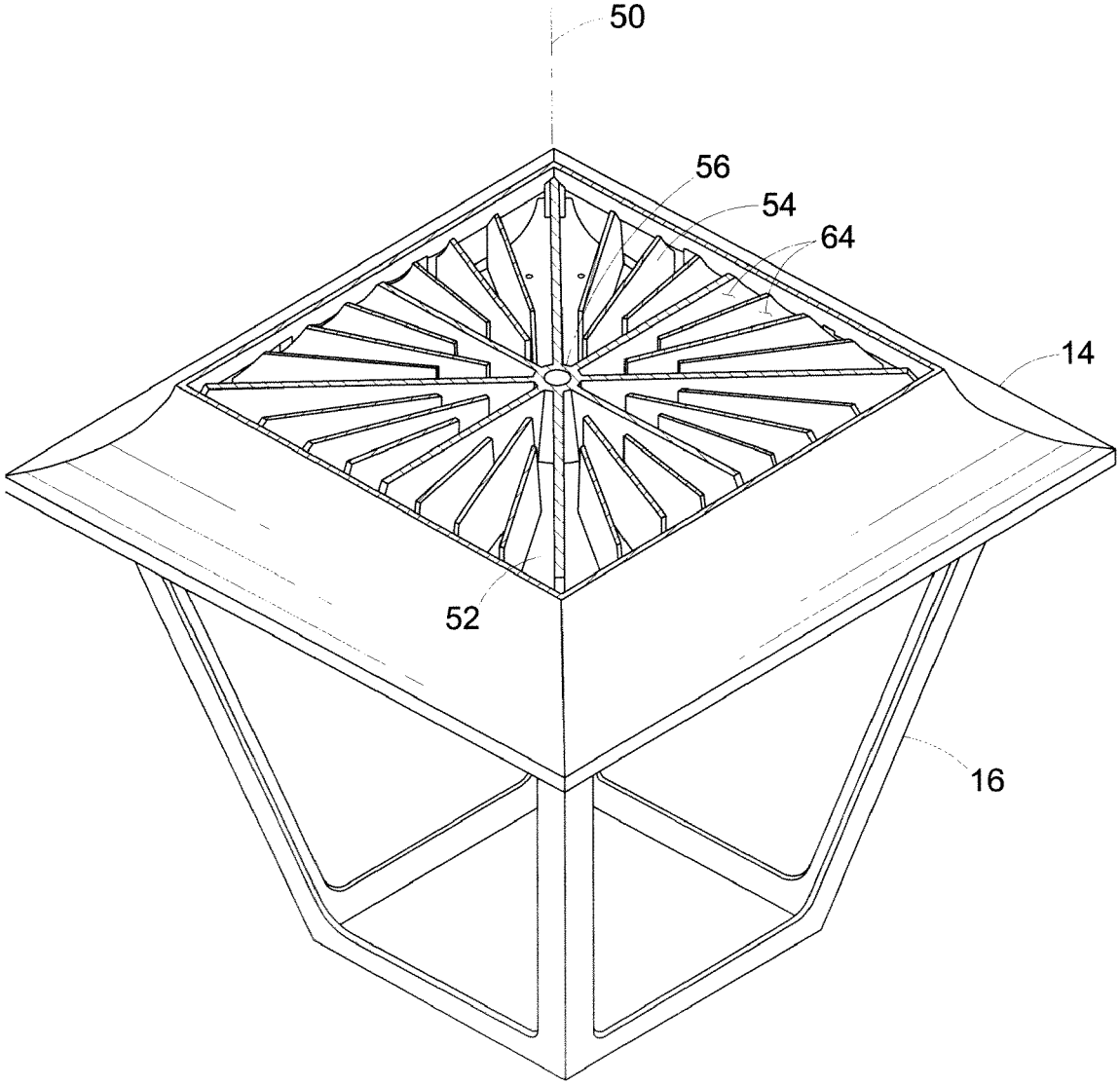
FIG. 6 is a cross-sectional view shown in perspective taken along line 6-6 in FIG. 7.

With reference back to FIGS. 2 and 3, the heat sink 20 includes a base 52 and a plurality of spaced fins 54. With reference to FIGS. 4 and 6, the fins 54 extend upwardly from the base 52 into the internal volume 46 of the shroud 14 and are arranged to be in thermal communication with the air path such that air passing through the air inlet passes through spaces between adjacent fins prior to passing through the air exhaust 44. The fins 54 of the illustrated embodiment radiate from the central axis 50. The fins 54 are angularly spaced from one another around the central axis 50. With reference to FIG. 6, the heat sink 20 also includes a central pillar 56 that is coaxial with the central axis 50 and that extends upwardly from and normal to the base 52. Some of the fins 54 have internal edges that are contiguous with the pillar 56 and some fins have internal edges that are radially spaced from the pillar. Many fins 54 are shown in the depicted embodiment; however, the number of fins and the surface area occupied by the fins can be dependent upon the amount of power that is to be delivered to the LEDs 22 to provide the desired light output from the light fixture. Moreover, the radial fins 54 should allow higher air velocities through the light fixture due to natural convection as compared to fins having other orientations, but the fins can be provided to have other orientations other than the radial configuration that is shown. With reference to FIG. 4, each fin 54 includes a contoured distal edge 58 and the inner surface 62 of the shroud 14 is contoured to generally follow the distal edges of the fins.

Figure 5:
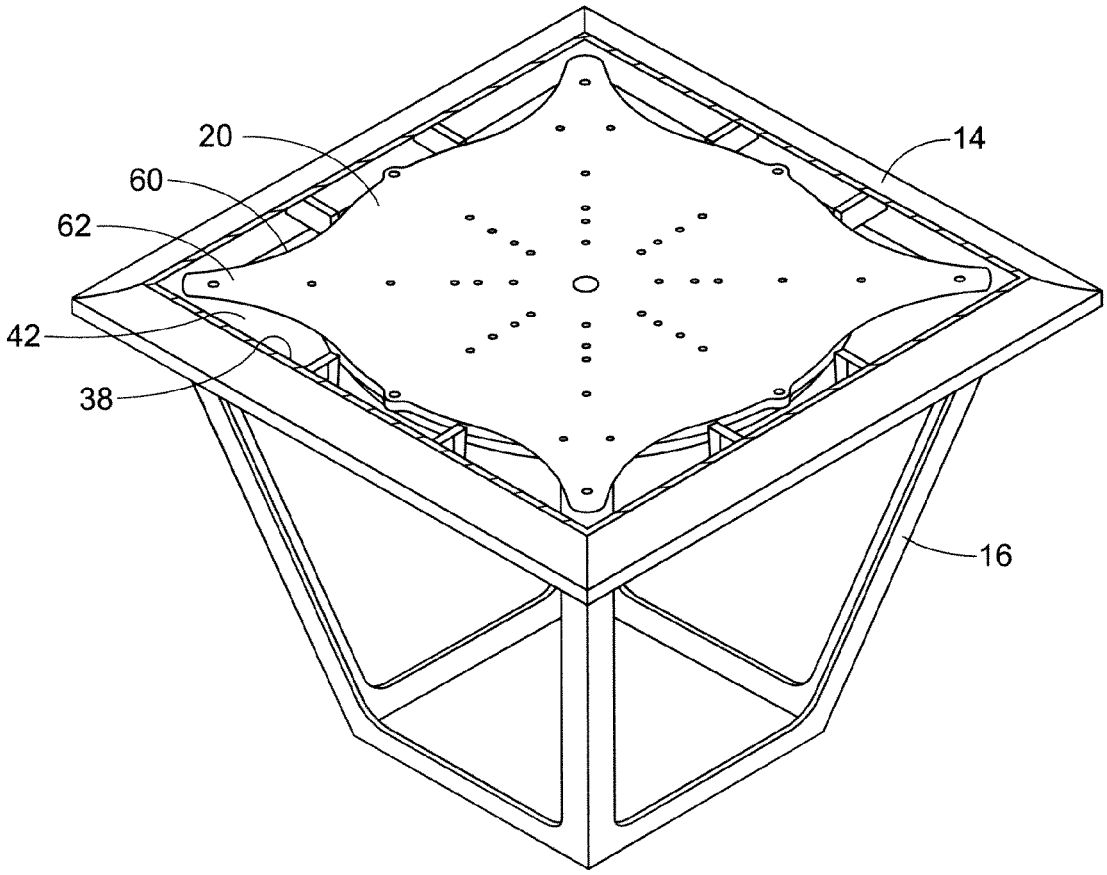
FIG. 5 is a cross-sectional view shown in perspective taken along line 5-5 in FIG. 7.

With reference to FIG. 5, the area of the air inlet 42 is shown which is defined by a peripheral edge 60 of the base 52 of the heat sink 20 and the internal surface 38 of the shroud 14. Much of the peripheral edge 60 of the base 52 of the heat sink 60 is offset from the internal surface 38 of the shroud. The heat sink 20 includes extensions 62 (four extensions in the illustrated embodiment) to provide an attachment location for attaching the heat sink to the shroud 14.

Figure 7:
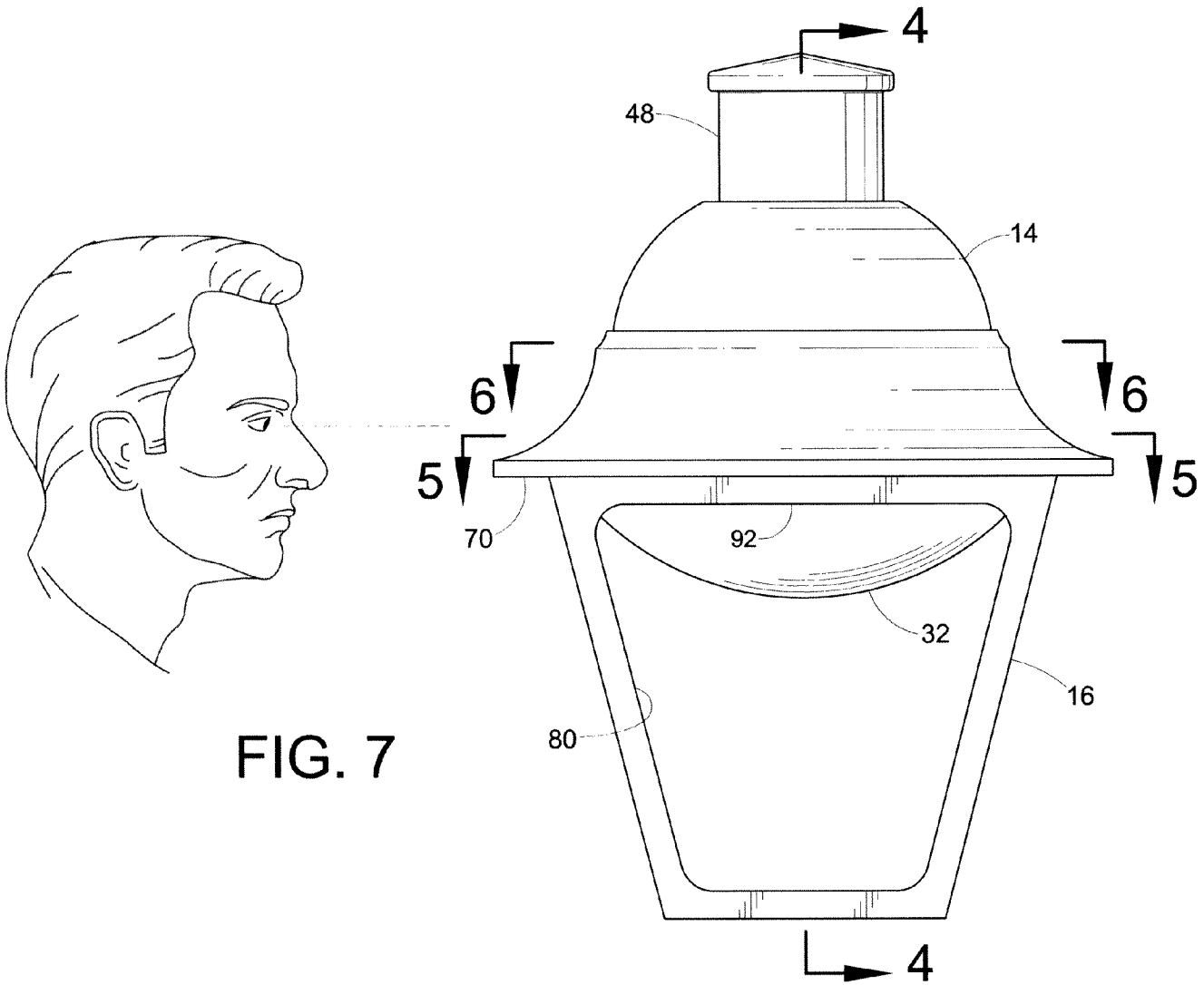
FIG. 7 is a side elevation view of the light fixture shown in FIG. 1 showing an alternative embodiment of a translucent cover for the light engine.

FIG. 5 depicts an isometric view of a cross section taken normal to the central axis 50 through the shroud 14 and the heat sink 20 at the vertical location of the air inlet 42. FIG. 7 shows the location of the cross section of FIG. 5. With reference to FIG. 6, the shroud 14 and the heat sink 20 define an envelope 64, which is the internal volume 46 of the shroud 14 above the lower surface 26 of the heat sink 20 less the volume occupied by the heat sink. The cross-sectional area of the envelope 64 normal to the central axis 50 at locations above the lower surface 26 of the heat sink 20 taken through the heat sink is at least about 90% and less than about 150% of the area of the air inlet 42. More desirably, the cross-sectional area of the envelope normal to the central axis at locations above the lower surface of the heat sink and taken through the heat sink is at least about 100% and less than about 120% of the area of the air inlet 42. Even more desirably, the area of the exhaust 44 is about 20% to about 30% less than the area of the inlet 42.

For example, the area of the air inlet 42 is shown in FIG. 5. With reference to FIG. 6, the area of the envelope 64, which can be considered as the spaces between adjacent fins 54, through the cross section shown in FIG. 6 is at least about 90% of the area of the air inlet and preferably less than about 150% of the area of the air inlet. This promotes a chimney effect where the shroud 14 acts as a chimney. Where the volume of the envelope 64 between the base 52 of the heat sink 20 and an upper edge of each heat fin 54 is too small, this can restrict airflow and not allow the highest possible velocity of airflow through the fixture to cool the LEDs. Where the volume of the envelope between the base 52 of the heat sink 20 and an upper edge of each fin 54 is too large, the air velocity over the heat sink can decrease as compared to an optimally designed envelope volume.

With reference to FIG. 4, the exhaust 44 is depicted schematically. With reference to FIG. 1, the exhaust 44 can be formed via openings 70 formed in the shroud 14. FIG. 1 shows three possible locations for these openings 70. It can be desirable to locate the openings 70 in locations that are protected from rainfall. Nevertheless, since the electrical components of the light engine 12 are disposed in a sealed cavity 34 (FIG. 4—an electrical cable, which is not shown, passes into the sealed cavity to provide energy) the exhaust openings 70 can be located in areas where the ingress of water is possible during a rain storm. It can be desirable to have the area of the exhaust 44, which would be the total surface area for the openings 70, to be at least about 70% of the area of the air inlet 42. The area of exhaust can also be less than about 80% of the area of the inlet. This promotes the chimney effect that is desirable to remove heat via convection. If the ratio of the exhaust area to the air inlet area is too large or too small, this could be detrimental to the chimney effect. FIG. 1 simply depicts locations where the exhaust openings 70 can be located on the shroud. The number and the size of the exhaust openings will be dependent upon the area of the air inlet and the amount of power delivered to the light source of the light engine.

With reference back to FIG. 1, the lower housing 16 connects to the shroud 14 and includes openings 80 that are shaped to receive associated glass panels, which are typically found in decorative light fixtures that include an incandescent light source, a metal halide light source, or a halogen light source. This gives the decorative LED light fixture 10 the same general look as conventional light fixtures. The openings 80 can receive translucent panels 82 (only one is shown in FIG. 1) or can be left open to ambient such that air entering from ambient passes through the openings prior to entering the air inlet 42. For the embodiments that include translucent panels received in the openings 80, holes 84 in the lower housing 16 allow for the ingress of air to cool the light engine 12. The holes 84 shown in FIG. 1 are simply to show possible locations for such holes. The total surface area of these holes 84 is dependent upon the flow that is desired to cool the light engine. Moreover, it can be desirable to locate these holes 84 on generally horizontal surfaces that are covered by other components of the light fixture so that the openings are protected from rain and other elements.

With reference to FIG. 7, the LEDs, which are not visible in FIG. 7, are hidden by the shroud 14 or the lower housing 16 when viewed from horizontal at an elevation about equal to an elevation of the LEDs. To accomplish this, the LEDs are disposed vertically above at least one of a lowermost edge 90 of the shroud 14 or an uppermost edge 92 of the openings 80 in the lower housing 16. This obscures the point light sources from view of a person viewing the LED light fixture 10 looking downward or horizontally with respect to the light engine and the central axis 50. This obscures the point light sources and provides for a more attractive light fixture. If desired, the translucent cover 32 can be changed from its flat configuration shown in FIG. 1 to a hemispherical configuration shown in FIG. 7, but it still may be desirable to locate the LEDs so that they are hidden from view.

A decorative light fixture has been described with reference to the particular embodiments. Modifications and alterations will occur to those skilled in the art upon reading and understanding the preceding detailed description. It is intended that the invention be construed as including all such modifications and alterations insofar as they come within the scope of the appended claims or the equivalents thereof.

The invention claimed is:

1. A light fixture comprising:

a light engine including a heat sink and a light source in thermal communication with the heat sink;

a shroud covering the heat sink to define an air path between an air inlet and an exhaust, the air inlet being disposed vertically below the exhaust and the air path being shaped to direct air over the heat sink and to exit the shroud above the light engine; and wherein the shroud defines a central axis and the heat sink includes a base, fins that extend upwardly from the base and radiate from the central axis, and a central pillar coaxial with the central axis and extending upwardly from and normal to a base of the heat sink, some fins having internal edges being contiguous with the pillar and some fins having internal edges being spaced from the pillar.

2. The fixture of claim 1, wherein the air inlet and the exhaust are each in communication with ambient.

3. The fixture of claim 2, wherein the cross-sectional area normal to the central axis of a volume surrounded by the shroud adjacent the inlet is greater than the cross-sectional area normal to the central axis of the volume adjacent the outlet.

4. The fixture of claim 3, wherein the heat sink includes fins, the cross-sectional area of an envelope normal to the central axis and through the heat sink, being at least about 90% and less than about 150% of the area of the air inlet, wherein the envelope is the volume above the lower surface of the heat sink surrounded by the shroud less the volume occupied by the heat sink.

5. The fixture of claim 1, further comprising a translucent cover connected to the heat sink to define a sealed cavity, the light source being disposed in the sealed cavity.

6. The fixture of claim 1, wherein portions of a peripheral edge of the heat sink are spaced from an internal surface of the shroud.

7. The fixture of claim 1, wherein the area of the air inlet is at least about 20% larger than the area of the exhaust.

8. The fixture of claim 7, wherein the area of the air inlet is less than about 30% larger than the area of the exhaust.

9. The fixture of claim 1, wherein the shroud tapers inwardly toward a vertical axis.

10. The fixture of claim 1, wherein the shroud defines a vertical axis and the heat sink includes fins that radiate from the vertical axis.

11. The fixture of claim 10, wherein the fins include a contoured distal edge each contoured to generally follow an inner surface of the shroud.

12. The fixture of claim 1, further comprising a lower housing connected to the shroud, the lower housing including openings shaped to receive associated glass panels.

13. The fixture of claim 12, wherein the openings are in communication with the air inlet such that air from ambient entering the air inlet passes through the openings.

14. The fixture of claim 12, further comprising translucent panels received in the openings.

15. The fixture of claim 12, wherein a lowermost edge of the light engine is disposed vertically above at least one of a lowermost edge of the shroud or an uppermost edge of the openings in the lower housing.

16. The fixture of claim 1, further comprising a lower housing connected to the shroud wherein the light source is a plurality of LEDs, and the LEDs are hidden by the shroud or the lower housing when viewed from horizontal at an elevation about equal to an elevation of the LEDs.

17. The fixture of claim 1, wherein the light source is a plurality of LEDs.

18. A light fixture comprising:

a light engine including a heat sink and a light source in thermal communication with the heat sink; and a shroud defining a central axis and an internal volume and covering the heat sink to define an air path through the internal volume between an air inlet and an air exhaust, the air inlet being disposed vertically below the air exhaust;

wherein the heat sink comprises a base and a plurality of spaced fins extending into the internal volume of the shroud from the base of the heat sink and radiating from the central axis and arranged to be in thermal communication with the air path such that air passing through the air inlet passes through spaces between adjacent fins prior to passing through the air exhaust.

19. A light fixture comprising:

a light engine including a heat sink and a light source in thermal communication with the heat sink;

a shroud defining a central axis and covering the heat sink to define an air path between an air inlet and an exhaust, the air inlet being disposed vertically below the exhaust and the air path being shaped to direct air over the heat sink and to exit the shroud above the light engine;

wherein the heat sink includes a base and fins that extend upwardly from the base and radiate from the central axis.

20. The fixture of claim 19, wherein heat sink further includes a central pillar coaxial with the central axis and extending upwardly from and normal to a base of the heat sink; and wherein some of the fins have internal edges being contiguous with the pillar and some of the fins have internal edges being spaced from the pillar.

* * * * *